US009201398B2

(12) United States Patent
Cusin et al.

(10) Patent No.: US 9,201,398 B2
(45) Date of Patent: Dec. 1, 2015

(54) OSCILLATING MECHANISM WITH AN ELASTIC PIVOT AND MOBILE ELEMENT FOR TRANSMITTING ENERGY

(75) Inventors: Pierre Cusin, Villars-Burquin (CH); Christian Charbon, Chezard-St-Martin (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 84 days.

(21) Appl. No.: 13/810,937

(22) PCT Filed: Jul. 4, 2011

(86) PCT No.: PCT/EP2011/061244

§ 371 (c)(1),
(2), (4) Date: Mar. 28, 2013

(87) PCT Pub. No.: WO2012/010408

PCT Pub. Date: Jan. 26, 2012

(65) Prior Publication Data

US 2013/0176829 A1 Jul. 11, 2013

(30) Foreign Application Priority Data

Jul. 19, 2010 (CH) ..... 1198/10
Nov. 18, 2010 (EP) ..... 10191774

(51) Int. Cl.
*G04B 15/00* (2006.01)
*G04F 5/00* (2006.01)
(Continued)

(52) U.S. Cl.
CPC ..... *G04B 17/00* (2013.01); *G04B 13/025* (2013.01); *G04B 15/00* (2013.01); *G04B 15/14* (2013.01);
(Continued)

(58) Field of Classification Search
CPC ..... G04B 17/20; G04B 17/26; G04B 17/28; G04B 17/285; G04B 13/02; G04B 13/025
USPC ..... 368/124–128, 164–168, 171
See application file for complete search history.

(56) References Cited

U.S. PATENT DOCUMENTS 965,505 A * 7/1910 Ecaubert ..... 368/171
965,506 A * 7/1910 Ecaubert ..... 368/171
(Continued)

FOREIGN PATENT DOCUMENTS

CH 6659 12/1893
CH 166267 12/1933
(Continued)

OTHER PUBLICATIONS

International Search Report Issued Aug. 24, 2011 in PCT/EP11/61244 Filed Jul. 4, 2011.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

An oscillating mechanism for a timepiece movement, including a first rigid element and a second rigid element, each one fixed on a different element of the movement and at least one of which is mobile relative to the other and pivots about an axis. The mechanism is monobloc and flexible with a variable geometry, and includes a first elastic restoring mechanism producing an elastic connection between the first rigid element and an intermediate rigid element, and a second elastic restoring mechanism producing an elastic connection between the intermediate element and the second rigid element, which all are coplanar according to one plane and configured to be deformed according to the plane.

21 Claims, 7 Drawing Sheets

(51) Int. Cl.

| | |
|---|---|
| ***G04B 17/20*** | (2006.01) |
| ***G04B 17/00*** | (2006.01) |
| ***G04B 17/28*** | (2006.01) |
| ***G04B 17/02*** | (2006.01) |
| ***G04B 13/02*** | (2006.01) |
| ***G04B 15/14*** | (2006.01) |
| ***G04B 17/06*** | (2006.01) |
| ***G04B 17/26*** | (2006.01) |
| ***G04F 7/08*** | (2006.01) |

(52) U.S. Cl.
CPC ..... *G04B 17/02* (2013.01); *G04B 17/063* (2013.01); *G04B 17/20* (2013.01); *G04B 17/26* (2013.01); *G04B 17/28* (2013.01); *G04B 17/285* (2013.01); *G04F 7/0823* (2013.01)

(56) References Cited

U.S. PATENT DOCUMENTS

| | | | | |
|---|---|---|---|---|
| 2,274,832 | A * | 3/1942 | Hobbs | 464/85 |
| 2004/0237688 | A1 * | 12/2004 | Kunz | 74/440 |
| 2005/0217169 | A1 * | 10/2005 | Kunz | 47/33 |
| 2007/0237035 | A1 * | 10/2007 | Helfer et al. | 368/147 |
| 2008/0008051 | A1 * | 1/2008 | Marmy et al. | 368/170 |
| 2010/0054089 | A1 * | 3/2010 | Maier et al. | 368/169 |
| 2012/0014229 | A1 * | 1/2012 | Mallet et al. | 368/175 |
| 2013/0188461 | A1 * | 7/2013 | Mallet et al. | 368/173 |

FOREIGN PATENT DOCUMENTS

| | | | |
|---|---|---|---|
| CH | 343897 | | 12/1959 |
| CH | 474 101 | | 2/1969 |
| CH | 479 105 | | 4/1969 |
| DE | 27 14 020 | | 10/1978 |
| DE | 2714020 | A * | 10/1978 |
| EP | 1 253 275 | | 10/2002 |
| EP | 1 457 844 | | 9/2004 |
| EP | 1 580 624 | | 9/2005 |
| EP | 2 037 335 | | 3/2009 |
| EP | 2037335 | A3 * | 3/2009 |
| FR | 2 641 351 | | 7/1990 |

* cited by examiner

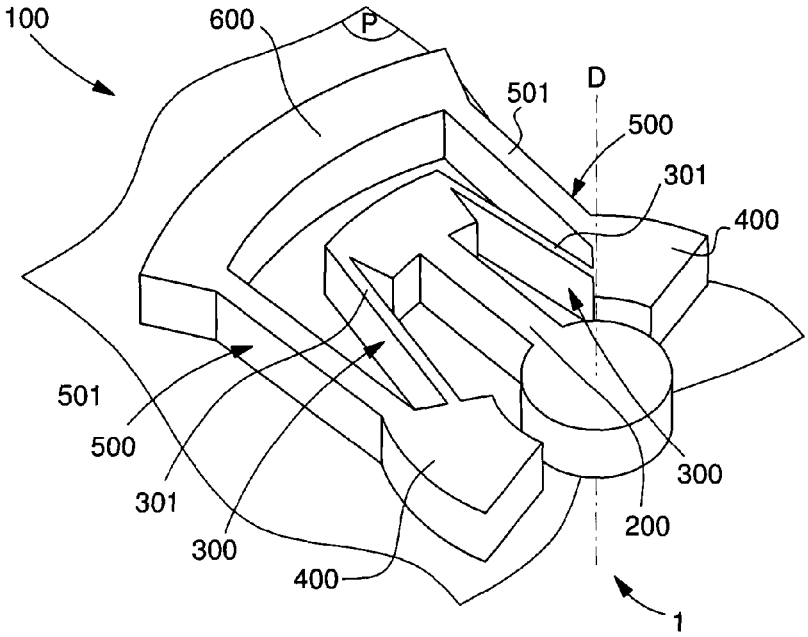
Fig. 7
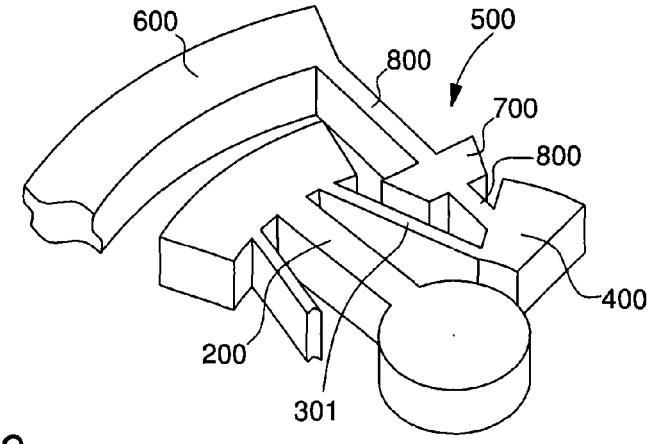
Fig. 8
Fig. 9
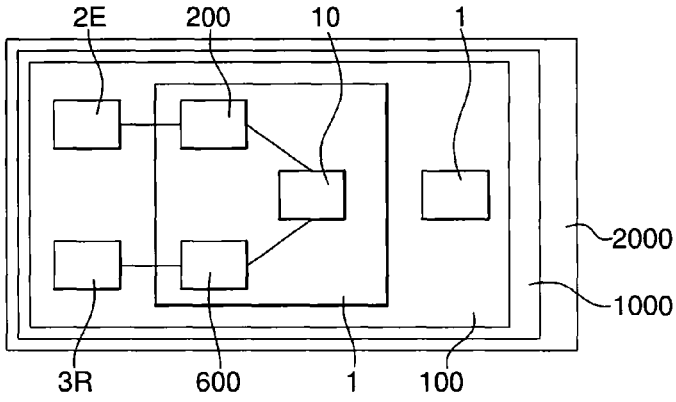

OSCILLATING MECHANISM WITH AN ELASTIC PIVOT AND MOBILE ELEMENT FOR TRANSMITTING ENERGY

FIELD OF THE INVENTION

The invention relates to an oscillating mechanism for a timepiece movement, comprising a first rigid element and a second rigid element, each one designed to be fixed on a different element of said movement and at least one of which is mobile relative to the other and pivots about a theoretical pivot axis.

The invention also relates to a mobile element for transmitting energy for a timepiece movement, comprising such an oscillating mechanism, between at least one first emitter mobile element of said movement, on the one hand, and at least one second receiver mobile element of said movement, on the other hand, said oscillating mechanism allowing at least one degree of freedom by pivoting about said theoretical pivot axis.

The invention also relates to a timepiece movement comprising such an oscillating mechanism.

The invention also relates to a timepiece comprising such an oscillating mechanism.

The invention also relates to the use of such a mobile element for transmitting energy in order to decouple the inertia of one part of a train of wheels in a timepiece movement comprising, on the one hand, an escapement and, on the other hand, a second mobile element of inertia which is greater than that of said escapement, by interposition of said mobile element for transmitting energy, either directly or in a train of wheels, between said escapement and said second mobile element in order to allow rapid pivoting of said escapement before said second mobile element is set in motion with each impulse.

The invention relates to the field of micromechanics and more particularly the field of clock/watch making.

BACKGROUND OF THE INVENTION

The manufacture of oscillating mechanisms for micromechanics, and in particular for clock/watch making, often resorts to elastic restoring means generally formed by springs. Being delicate to implement, these components are in addition difficult to position and require a qualified workforce or/and expensive apparatus. Such springs are generally made of steel in order to have a long lifespan and at the same time a large restoring moment. Manufacture thereof is very much dependent upon the quality of the initial material used but also upon the thermal treatments which are effected. For this reason, manufacture of springs is not very reproducible and all the mechanisms incorporating them must be subject to regulation or adjustment.

Elastic restoring means in the form of shape memory materials are also known, such as vulcanised rubber or certain elastomers. The use of elastic blocks of this type is known in heavy mechanical engineering, often in conjunction with a silent-block function or more generally for damping. Apart from the fact that their use in micromechanics is difficult, it is observed that precisely these properties of damping vibrations, and therefore of damping oscillations, run counter to the objective if, on the contrary, maintaining an oscillation is desired, with the minimum of damping.

Some devices have been developed with elastic wheels, for instance a mobile element of the train of watchworks, according to document CH 343 897 in the name of Rolex, comprises an elastic linking device which becomes taut under the influence of the motor spring when the escapement wheel is stationary or during its slight backward movement before disengagement, and slackens at the moment of disengagement so as to act on the set of pallets with a constant force in order to reduce the separation between the teeth of the escapement wheel and the impulse plane of the pallet stones of the set of pallets at the beginning of each impulse movement.

Elastic wheels are known from documents CH 6659 in the name of Lambert, with S-shaped arms, or also DE 271 4020 in the name of Beiter, with spiral arms, or also EP 1 580 624 in the name of Pierre Kunz, which has a mobile element which is sufficiently elastic to undergo displacements without changing its centre difference of axes and without changing its meshing ratio, or EP 1 457 844 in the name of Pierre Kunz which uses a spacer made of elastic foam in place of the elastic arms of the preceding case. Anti-noise pinions with an elastic structure are also known from document FR 2 641 351 in the name of Alcatel, and also wheels comprising integrated dampers as in document EP 1 253 275 in the name of Siemens.

SUMMARY OF THE INVENTION

The invention proposes to provide, for the fields of micromechanics and clock/watch making, a reliable alternative to the use of traditional springs as means for maintaining an oscillation. This alternative is in demand just as much for micromechanical productions as for nanotechnologies.

To this end, the invention relates to an oscillating mechanism for a timepiece movement, comprising a first rigid element and a second rigid element, each one designed to be fixed on a different element of said movement and at least one of which is mobile relative to the other and pivots about a theoretical pivot axis, characterised in that said oscillating mechanism is flexible with a variable geometry, whilst being produced in a monobloc manner, and comprises first elastic restoring means which produce a direct or indirect elastic connection between said first rigid element and an intermediate rigid element, and comprises at least second elastic restoring means which produce a direct or indirect elastic connection between said intermediate rigid element and said second rigid element, and also characterised in that said first rigid element, said first elastic restoring means, said intermediate rigid element, said second elastic restoring means, and said second rigid element are coplanar according to the same plane, and are designed to be deformed according to said plane.

According to a feature of the invention, said oscillating mechanism assumes a configuration of the butterfly type, comprising at least one intermediate rigid element, formed by at least one rigid arm which extends between said first rigid element disposed in the vicinity of said pivot axis and said second rigid element forming a peripheral part, to which it is connected respectively by said first elastic restoring means formed by at least one first elastic blade, and by said second elastic restoring means formed by at least one second elastic blade, said rigid part forming an intermediate mass which is mobile substantially by pivoting about said pivot axis.

According to another feature of the invention, said oscillating mechanism assumes a configuration of the RCC pivot type with four necks, comprising two said rigid intermediate elements forming two non-aligned arms, each extending between said first rigid element disposed in the vicinity of said pivot axis and said second rigid element forming a peripheral part, to which it is connected respectively by said first elastic restoring means formed by at least one first elastic blade, and by said second elastic restoring means formed by at least one second elastic blade.

According to a particular feature, said first rigid element or said second rigid element comprises means for receiving an impulse exerted counter to said first elastic restoring means and said second elastic restoring means, which together form elastic restoring means which are designed to make said first rigid element oscillate about said pivot axis, said elastic restoring means forming a virtual elastic pivot which releases said oscillating mechanism from any fixing on arbor or pivot, and said elastic restoring means comprise means for balancing the forces exerted on said first rigid element in order to keep its instantaneous pivot axis as close as possible to said pivot axis.

The invention also relates to a mobile element for transmitting energy for a timepiece movement, comprising such an oscillating mechanism, between at least one first emitter mobile element of said movement, on the one hand, and at least one second receiver mobile element of said movement, on the other hand, said oscillating mechanism allowing at least one degree of freedom by pivoting about said theoretical pivot axis, characterised in that said first elastic restoring means and said second elastic restoring means together form elastic restoring means which produce a direct or indirect elastic connection between a first axial part and a second peripheral part, said first axial part being situated in the vicinity of said pivot axis and cooperating with said first emitter mobile element or respectively the second receiver mobile element, and said second peripheral part being at a radial spacing from said pivot axis and cooperating with said second receiver mobile element or respectively the first emitter mobile element, and said elastic restoring means being designed, as the case may be, to absorb, to store or to set free the energy during an angular deflection by pivoting about a secondary axis which is parallel to or coincides with said pivot axis, between said first axial part and said second peripheral part.

According to a feature of the invention, said first axial part and said second peripheral part are coaxial in the free state, and said elastic restoring means are again designed to keep said first axial part and said second peripheral part coaxial during deformation of said elastic restoring means.

The invention also relates to a timepiece movement comprising such an oscillating mechanism.

The invention also relates to a timepiece comprising such an oscillating mechanism.

The invention also relates to the use of such a mobile element for transmitting energy in order to decouple the inertia of one part of a train of wheels in a timepiece movement comprising, on the one hand, an escapement and, on the other hand, a second mobile element of inertia which is greater than that of said escapement, by interposition of said mobile element for transmitting energy, either directly or in a train of wheels, between said escapement and said second mobile element in order to allow rapid pivoting of said escapement before said second mobile element is set in motion with each impulse.

BRIEF DESCRIPTION OF THE DRAWINGS

Other features and advantages of the invention will be understood better upon reading the description which will follow, with reference to the appended drawings where:

FIG. 7 represents, schematically and in perspective, a mobile element for transmitting energy according to the invention, incorporating such an oscillating mechanism, in a simplified representation;

FIG. 8 represents, schematically and in perspective, a mobile element for transmitting energy according to the invention, incorporating such an oscillating mechanism, in a simplified representation of another variant;

FIG. 9 represents, in the form of a block diagram, a timepiece incorporating a movement which itself comprises such a mobile element for transmitting energy and such an oscillating mobile element.

DETAILED DESCRIPTION OF PREFERRED EMBODIMENTS

Figure 1:
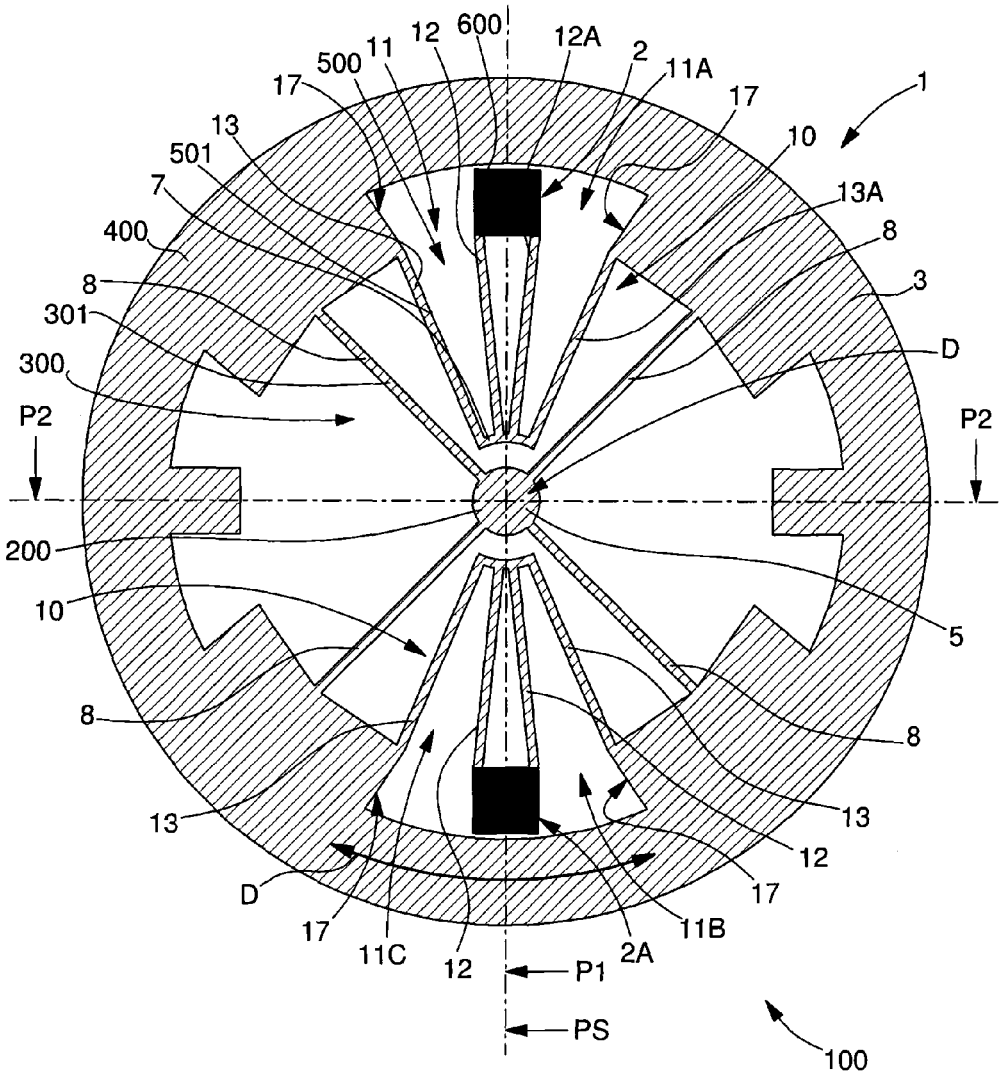
FIG. 1 represents, schematically and in section according to a plane perpendicular to a theoretical pivot axis, an oscillating mechanism according to the invention, in a first embodiment which is suitable for production of an element regulating a timepiece.

The invention relates to the field of micromechanics and more particularly the field of clock/watch making.

The invention relates to an oscillating mechanism 1 for a timepiece movement 1000. This oscillating mechanism 1 comprises a first rigid element 200 and a second rigid element 600, each one designed to be fixed on a different element of the movement 1000 and at least one of which is mobile relative to the other and pivots about a theoretical pivot axis D.

According to the invention, this oscillating mechanism 1 is flexible with a variable geometry, whilst being produced in a monobloc manner. It comprises first elastic restoring means 300 which produce a direct or indirect elastic connection between the first rigid element 200 and an intermediate rigid element 400. It comprises at least second elastic restoring means 500 which produce a direct or indirect elastic connection between this intermediate rigid element 400 and the second rigid element 600.

Furthermore, the first rigid element 200, the first elastic restoring means 300, the intermediate rigid element 400, the second elastic restoring means 500 and the second rigid element 600 are coplanar according to a plane P, and are designed to be deformed preferably according to plane P.

In a preferred embodiment, as can be seen in the Figures, the first elastic restoring means 300 comprise at least one elastic blade 301, and the second elastic restoring means 500 comprise at least one elastic blade 501.

In an embodiment variant, the first elastic restoring means 300 comprise a plurality of elastic blades 301 which are substantially radial relative to the pivot axis D, and the second elastic restoring means 500 comprise a plurality of elastic blades 501 which are substantially radial relative to the pivot axis D.

In an advantageous implementation of the invention, the first elastic restoring means 300 or/and the second elastic restoring means 500 comprise a plurality of elastic blades which form dihedrons with a V substantially radial relative to the pivot axis D, and the point of the V of which is directed towards the pivot axis D.

In a variant which can be seen in FIG. 8, the first elastic restoring means 300 or/and the second elastic restoring means 500 comprise at least one rigid element 700 which is intercalated between two elastic elements 800.

For preference, the oscillating mechanism 1 is symmetrical relative to a plane of symmetry PS passing through the pivot axis D and perpendicular to the plane P:

As can be seen in FIGS. 1 to 5, an advantageous embodiment of the invention is that where the oscillating mechanism 1 assumes a configuration of the butterfly type, comprising at least one intermediate rigid element 400, formed by at least one rigid arm 12 which extends between the first rigid element 200 disposed in the vicinity of the pivot axis D and the second rigid element 600 forming a peripheral part 60, to which it is connected respectively by the first elastic restoring means 300 formed by at least one first elastic blade 8, and by the second elastic restoring means 500 formed by at least one second elastic blade 90, the rigid part 12 forming an intermediate mass which is mobile substantially by pivoting about the pivot axis D.

Figure 6:
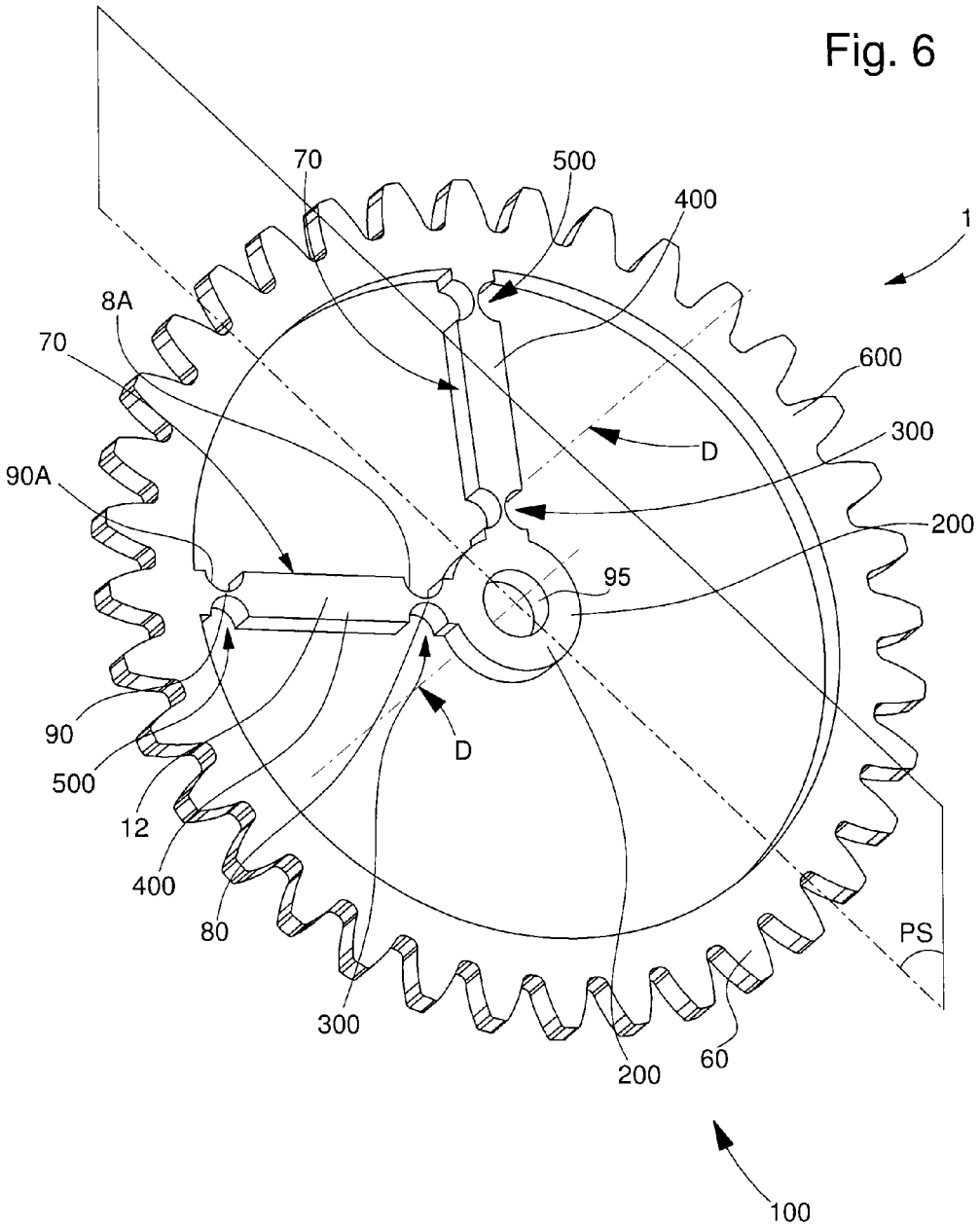
FIG. 6 represents, schematically and in perspective, a mobile element for transmitting energy according to the invention, incorporating such an oscillating mechanism, in a second variant of a form termed "RCC with four necks"

Another advantageous embodiment which can be seen in FIG. 6 is that where the oscillating mechanism 1 assumes a configuration of the RCC pivot type with four necks, comprising two such intermediate rigid elements 400 which form two non-aligned arms 70, each extending between the first rigid element 200 disposed in the vicinity of the pivot axis D and the second rigid element 600 forming a peripheral part 60, to which it is connected respectively by the first elastic restoring means 300 formed by at least one first elastic blade 8, and by the second elastic restoring means 500 formed by at least one second elastic blade 90.

For preference, the first elastic restoring means 300 or/and the second elastic restoring means 500 have an angular deflection limited by means for limiting the angular deflection.

In another implementation, as can be seen in FIGS. 1 to 4, the second rigid element 600 forms an anchorage immobile relative to a bottom plate or to a bridge which comprises the movement 1000. Of course the first rigid element 200 can also form this anchorage.

In this implementation, the rigid element which does not form the anchorage, here the first rigid element 200 in the case of the Figures, comprises means for receiving an impulse exerted counter to the first elastic restoring means 300 and second elastic restoring means 500. The latter together form elastic restoring means 10 which are designed to make the first rigid element 200 oscillate about the pivot axis D. The elastic restoring means 10 form a virtual elastic pivot which releases the oscillating mechanism 1 from any fixing on arbor or pivot. For preference, the elastic restoring means 10 comprise means for balancing the forces exerted on the first rigid element 200, or/and on the intermediate rigid element 400, or/and on the second rigid element 600, in order to keep its instantaneous pivot axis as close as possible to the pivot axis D.

Advantageously the oscillating mechanism 1 comprises stopping means or at least one pawl, in order to retain it in position at a distance from its equilibrium position, either all or part of the elements which make up the elastic restoring means 10, or/and the first rigid element 200, or/and the second rigid element 600.

For preference and allowing an industrial production which is very precise and at the same time economical, the oscillating mechanism 1 is monobloc and produced in a micromachinable material, or silicon, or silicon oxide, or quartz, or one of their compounds, or an alloy originating from MEMS technology, or an alloy such as obtained by the "LIGA" process, or in a combination of these materials. For preference, the chosen material is a rigid material of a Young's modulus greater than 80,000 MPa. Such micromachinable materials lend themselves particularly well to production by layers such as presented above, with at least two layers, for example two or three layers on which the various components of the elastic restoring means 10 are distributed and linked to each other.

Figure 2:
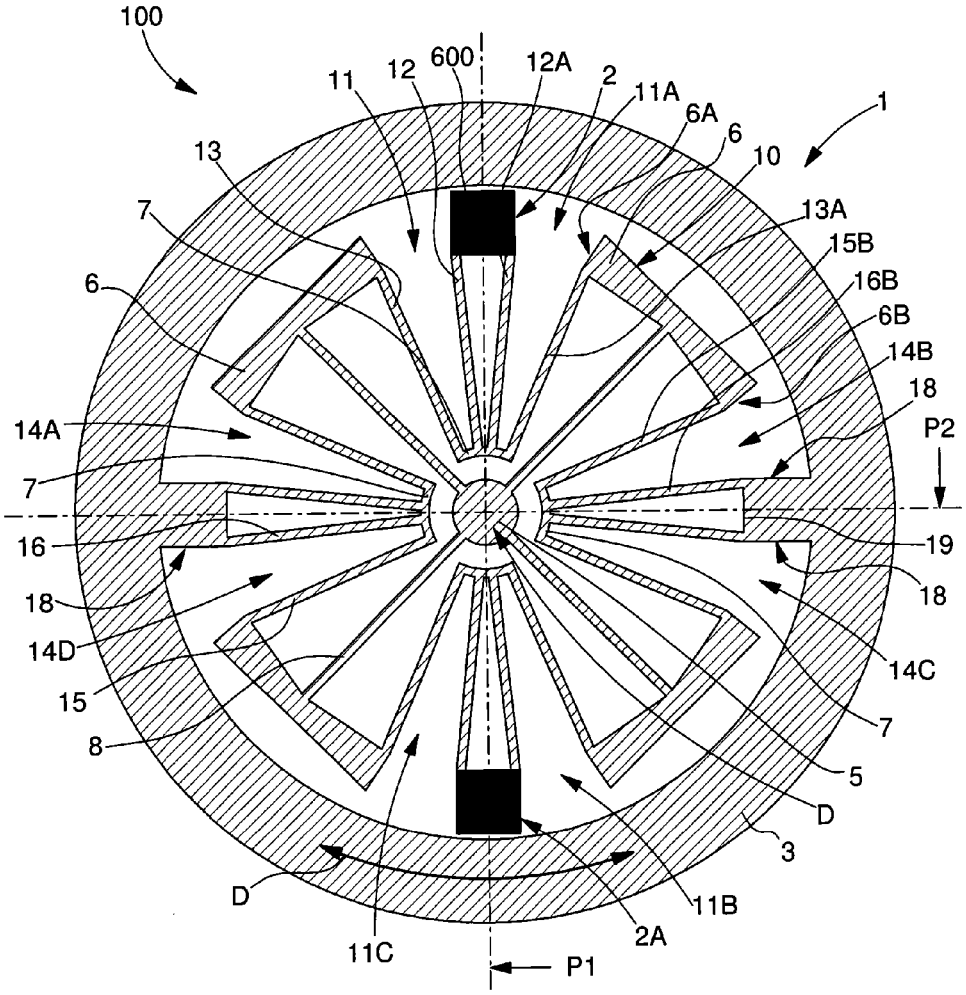
FIG. 2 represents, in a manner similar to FIG. 1, a variant of this first mode in a version with greater pivot amplitude than that of FIG. 1.
Figure 4:
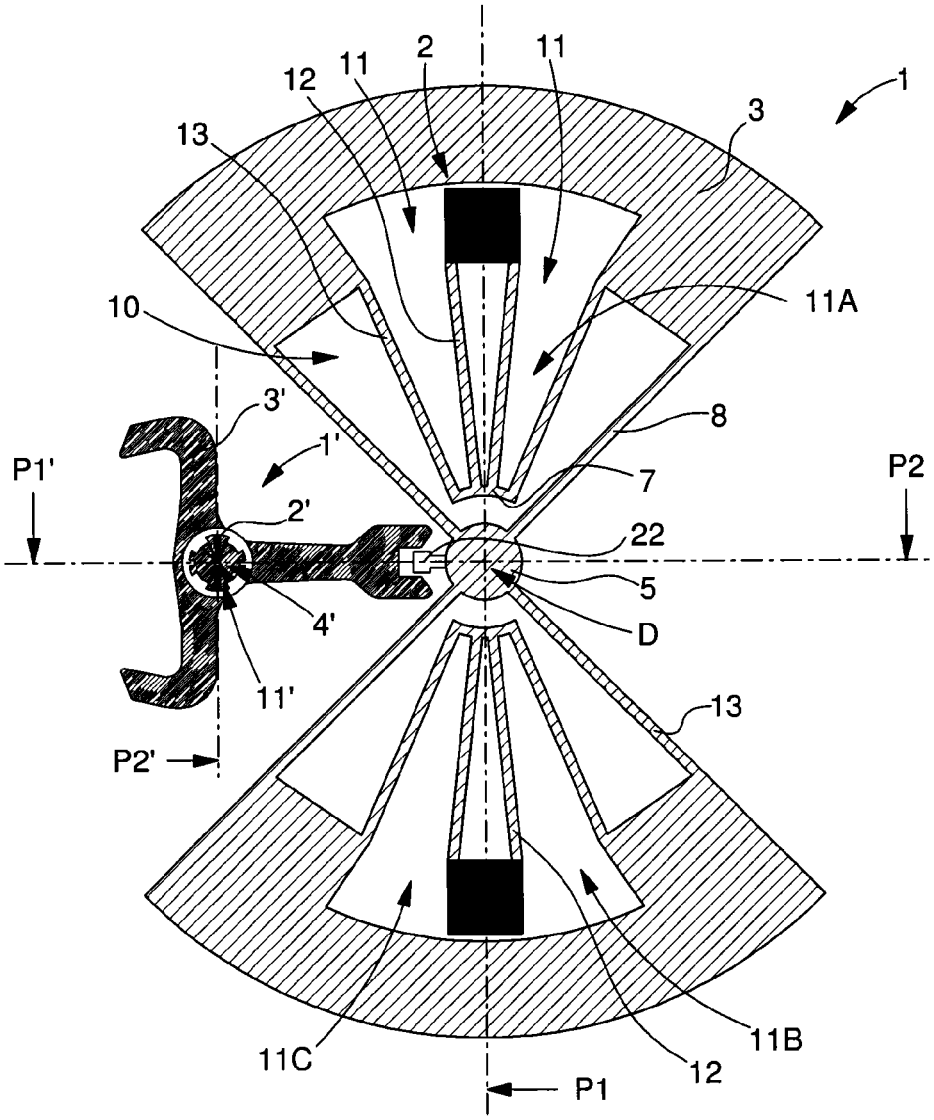
FIG. 4 represents schematically, analogously to the preceding Figures, an oscillating mechanism according to the invention, in a combined version of these first and second embodiments, which is suitable for the production of an escapement-oscillator block designed to regulate the timekeeping of a timepiece.

In a particular application, such as can be seen in FIGS. 1, 2 and 4, the intermediate rigid element 400, formed by a first component 3, is a balance rim of a mechanical rotary oscillator with its elastic centre, of an assembly regulating the timepiece. In this embodiment, advantageously the first rigid element 200, or the second component 5, is a balance plate and comprises an impulse pin 22 which is designed to cooperate with a set of pallets such as can be seen in FIG. 4.

Figure 3:
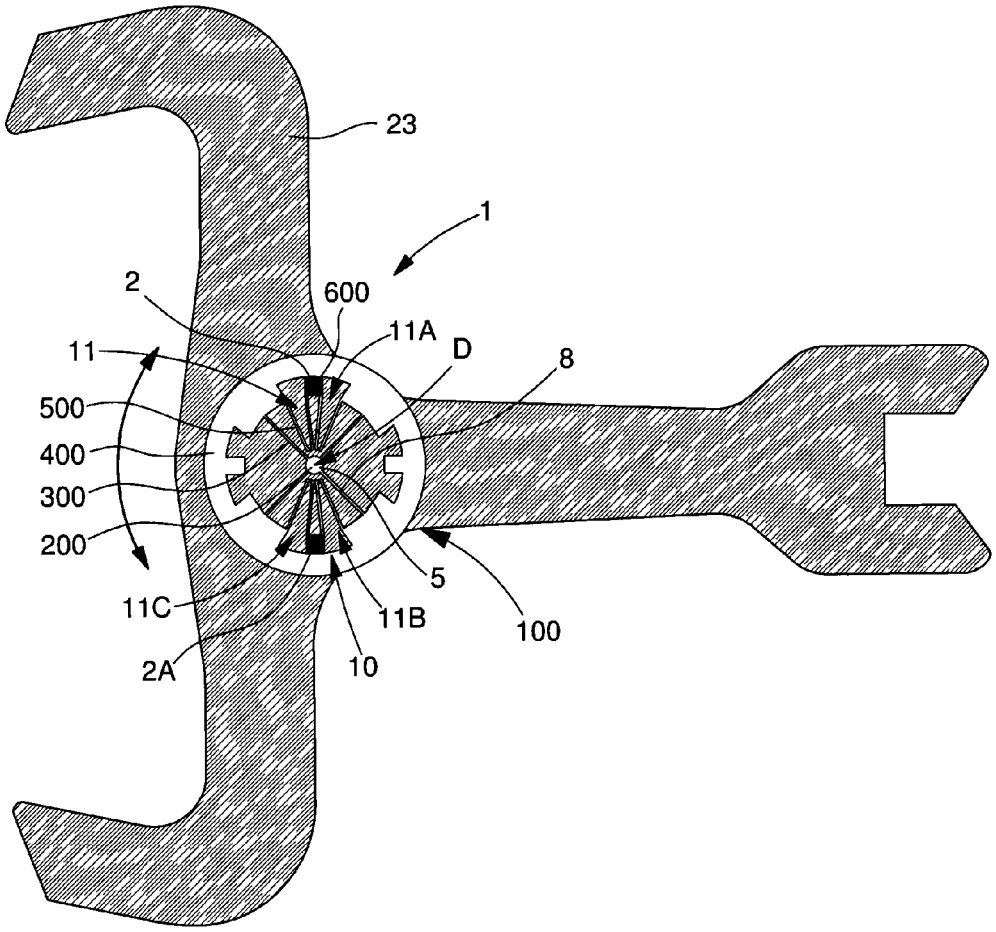
FIG. 3 represents schematically, analogously to the preceding Figures, an oscillating mechanism according to the invention, in a second embodiment which is suitable for production of an escapement element, in particular of a set of pallets, of a timepiece.

In another particular application, such as can be seen in FIG. 3, the second rigid element 600 is integral with a pallet staff 23 of a set of pallets, or of Swiss pallets, or of detent pallets, with an elastic pivot, of the escapement mechanism of the timepiece. Thus the pallet staff is replaced.

In a combined version, which is particularly advantageous, of these two particular applications and which can be seen in FIG. 4, the oscillating mechanism 1 forms an escapement-oscillator block which is designed to regulate the timekeeping of a timepiece. It therefore advantageously comprises a boring 95 for centering an escapement wheel which is designed to provide the energy necessary for maintaining the oscillation, which makes it possible, in a preferred embodiment made of micromachinable material, to guarantee very great precision in the relative positioning of the mobile elements amongst each other.

In this case, advantageously the oscillating mechanism 1 is produced in the two parts of an "SOI" wafer, i.e. "device" for the set of pallets and its elastic pivot, and for the rotary mechanical oscillator and its elastic centre, and "handle" for anchoring the set of pallets and the mechanical oscillator and for the centering boring 95 of an escapement wheel.

In another application, not represented in the Figures, the oscillating mechanism 1 forms a ring mechanism escapement for a timepiece.

In another application, not represented in the Figures, the oscillating mechanism 1 forms a mobile escapement element which is situated between a spring barrel and a set of pallets at the level of the interface between a pinion and an escapement wheel of an escapement mechanism for a timepiece.

In another application, not represented in the Figures, the oscillating mechanism 1 forms a coupling of the timer mechanism for the timepiece.

In the particular embodiments illustrated in FIGS. 1 to 4, the oscillating mechanism 1 comprises at least an anchorage with an external device, in particular a bottom plate or a bridge of a movement 1000. This anchorage forms the second rigid element 600. In these similar embodiments, the intermediate rigid element 400 of the oscillating mechanism 1 comprises a first mobile component 3 at least pivotable about a first instantaneous pivot axis in the vicinity of a theoretical pivot axis D with a position determined and fixed relative to this anchorage 2 or, as the case may be, to these anchorages 2 if there is a plurality of them, as in the case of FIGS. 1 to 3 where two anchorages 2 are represented. The first rigid element 200 of the oscillating mechanism 1 comprises a second component 5 in the vicinity of this axis D. The first component 3 and the second component 5 are connected to each other directly or indirectly and one of them, first component 3 or second component 5, comprises means for receiving an impulse generated by motor means which are external or internal of the oscillating mechanism 1. This impulse is exerted counter to the elastic restoring means 10, which the oscillating mechanism 1 comprises and which are designed to make the first component 3 oscillate about the first instantaneous pivot axis. The oscillating mechanism 1 is monobloc, and the only means of fixing the oscillating mechanism to an external device are formed by the anchorage 2 or, as the case may be, the anchorages 2. For this reason, the elastic restoring means 10 form a virtual elastic pivot which frees the oscillating mechanism 1 from any fixing on the arbor or pivot. Advantageously, these elastic restoring means 10 comprise means for balancing forces exerted on the first component 3 in order to keep the first instantaneous pivot axis as close as possible to the theoretical pivot axis D.

In these particular embodiments of FIGS. 1 to 4, the elastic restoring means 10 comprise at least one first elastic element 11, the angular deflection of which is limited to the value of one pivot movement of the first component 3. This pivot movement of the first component 3 is itself determined by first means for limiting the angular deflection 17 relative to each radial originating from the axis D and joining each anchorage 2. For preference, each first elastic element 11 has very much lower rigidity than that of the first component 3, in a ratio less than 0.30 relative to that of the first component 3. In a preferred implementation of this particular embodiment, as can be seen in FIGS. 1 and 2, at least one, and preferably each first elastic element 11, extends radially relative to the axis D and from the anchorage 2 up to the first component 3, as can be seen in FIG. 1, or else up to a third component 6 which is connected directly or indirectly to the first component 3, as can be seen in FIG. 2.

Figure 5:
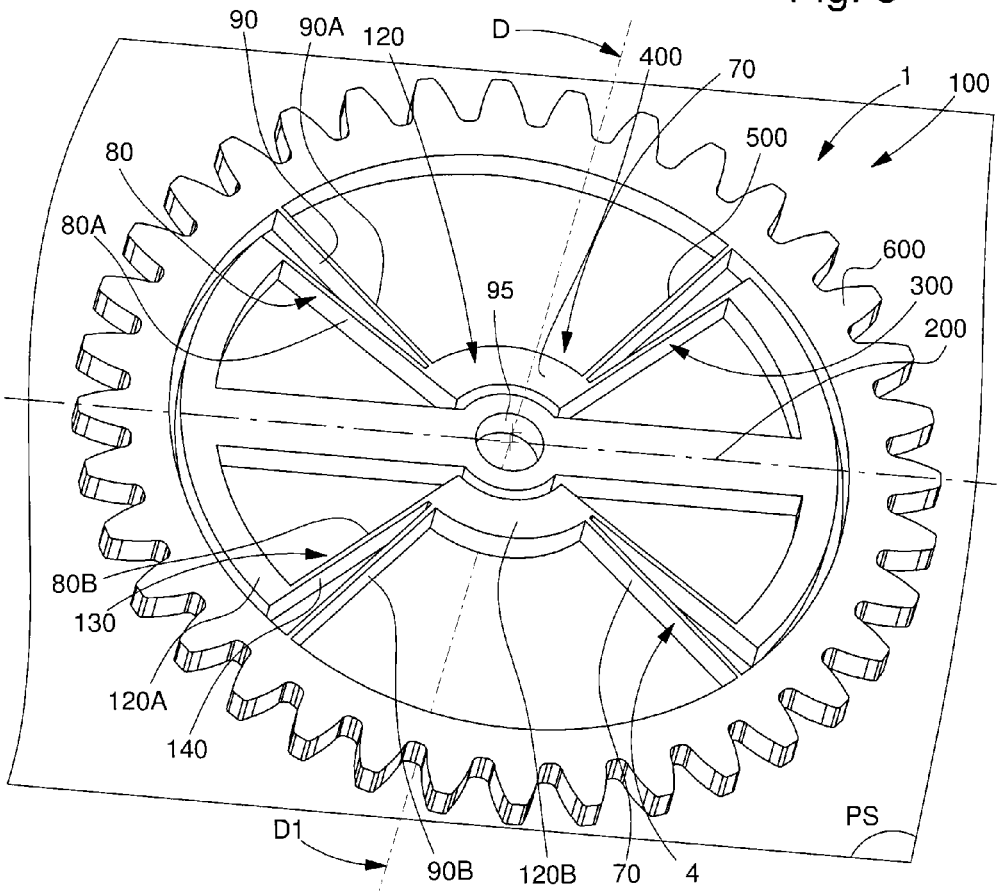
FIG. 5 represents, schematically and in perspective, a mobile element for transmitting energy according to the invention, incorporating such an oscillating mechanism, in a first variant of the shape termed "butterfly"

In an advantageous embodiment of this particular embodiment of FIGS. 1 to 4, and of the embodiment of FIG. 5, and particularly resistant to stresses originating from alternate deformations, the first elastic element 11 is termed a dihedron and is in the shape of a V or a truncated V. The point of this V is directed towards the axis D. The first elastic element 11 comprises a first elastic arm 12 which extends radially relative to the axis D, from the anchorage 2 towards the axis D up to a connecting surface 7 situated in the vicinity of the second component 5. This connecting surface 7 can be reduced to its simplest expression, i.e. punctiform. The first elastic element 11 also comprises a second elastic arm 13 which extends radially relative to the axis D, from the connecting surface 7 up to the first component 3, or else up to a third component 6 which is connected directly or indirectly to the first component 3, as can be seen in FIG. 2. In a particular, preferred embodiment, the first elastic arm 12 and the second elastic arm 13 are identical. For preference, they are symmetrical relative to a radial originating from the theoretical axis D.

In the variant of FIG. 2, in a version with greater pivot amplitude, the elastic restoring means 10 comprise at least one second elastic element 14 which is interposed directly or indirectly between the first elastic element 11 and the first component 3. The angular deflection of the second elastic element 14 is limited to the difference between the pivoting movement of the first component 3 which is determined by the means for limiting the angular deflection 17, on the one hand, and the angular clearance allowed by the elastic element 11, on the other hand. It is understood that, as far as the angular pivoting deflection of the first component 3 is concerned, it is substantially equal to the total of the angular deflections of the first elastic element 11 and of the second elastic element 14, associated together. In the example of the Figures, this first element 11 and this second element 14 are of similar geometry and rigidity characteristics, have a deflection of approx. +/−15°, the first component 3 therefore has a deflection of approx. +/−30°. As for the first elastic element, each second elastic element 14 advantageously has very much lower rigidity than that of the first component 3, in a ratio less than 0.30 relative to that of the first component 3. In the embodiment of FIG. 2, the oscillating mechanism 1 comprises at least one third component 6 which is connected to anchorage 2 by at least one first elastic element 11, and to the first component 3 by at least one second elastic element 14.

For preference, all the first elastic elements 11 of the same oscillating mechanism 1 are identical. For preference, all the second elastic elements 14 of the same oscillating mechanism 1 are identical. For preference all the third components 6 of the same oscillating mechanism 1, when it comprises them, are identical.

To return to the second elastic element 14, like the first elastic element 11, it extends preferably radially relative to the axis D and from either the first elastic element 11 or a third component 6 interposed between the second component 5 and the first component 3, up to the first component 3.

In the variant of FIG. 2, the second elastic element 14, termed a dihedron, is in the form of a V or a truncated V. The point of this V is directed towards the axis D. The second elastic element 14 comprises a first elastic arm 15 which extends radially relative to the axis D from either the first elastic element 11 or the third component 6, towards the axis D, up to a connecting surface 7A situated in the vicinity of the second component 5. And it comprises also a second elastic arm 16 which extends radially relative to the axis D from the connecting surface 7A up to the first component 3 or else up to another component which is connected directly or indirectly to the first component 3. The connecting surface 7A can also be reduced to its simplest expression, i.e. punctiform. In a particular, preferred embodiment, the first elastic arm 15 and the second elastic arm 16 are identical. For preference, they are symmetrical relative to a radial originating from the axis D.

In an advantageous embodiment, which can be seen in FIG. 2, the first elastic arm and the second elastic arm 13 of the first elastic element 11, and the first elastic arm 15 and the second elastic arm 16 of the second elastic element 14 are all identical to each other. For preference, they are symmetrical, two by two, relative to a radial originating from the axis D.

For preference, the first component 3 is connected rigidly to the second component 5 by at least one arm 8 and preferably by a plurality of arms 8. For preference, each arm 8 has greater rigidity than that of each of the elastic restoring means 10.

In total, in this variant of FIG. 2, the oscillating mechanism 1 comprises at least one third component 6 which is connected to the anchorage 2 by at least one first elastic element 11, and to the first component 3 by at least one second elastic element 14. The third component 6 is connected rigidly to the second component 5 by at least one rigid arm 8. Thus the second component 5 forms, with the third component 6, or as the case may be, the third components 6, and with the arm 8, or as the case may be, the arms 8, a second rigid mobile element 9 which is mobile by pivoting about a second instantaneous pivot axis which is very close to the axis D. The elastic restoring means 10 comprise means for balancing forces exerted on the second mobile element 9 in order to keep the second instantaneous pivot axis as close as possible to the theoretical pivot axis D.

In a preferred manner, as can be seen in FIGS. 1 to 3, the oscillating mechanism 1 comprises two anchorages 2, 2A with an external device, for example with a fixed point of a bottom plate, or otherwise. These two anchorage 2, 2A are preferably symmetrical relative to the axis D.

Advantageously, in order to compensate for all the forces, so as to bring the first instantaneous pivot axis of the first component as close as possible to the axis D, the oscillating mechanism 1, in the free state and stationary, is symmetrical relative to a plane of symmetry PS, here P1, perpendicular to the axis D and passing through at least one anchorage 2.

With the same objective, the oscillating mechanism 1, in the free state and stationary, is preferably symmetrical relative to another plane of symmetry PS, here a plane P2 perpendicular to the axis D and perpendicular to a straight line joining the two anchorages 2; 2A when it comprises two disposed in this way.

In a preferred embodiment combining these two symmetries, the oscillating mechanism 1, in the free state and stationary, is symmetrical relative to the axis D.

More generally, the oscillating mechanism 1 can comprise a plurality of anchorages 2 with an external device, which sets of pallets are equidistant from each other and relative to the axis D.

Preferably, as can be seen in FIGS. 1 to 4, the oscillating mechanism 1 comprises a plurality of first elastic elements 11 which are grouped in pairs on both sides of each anchorage 2.

Preferably, as can be seen in FIG. 2, the oscillating mechanism 1 comprises a plurality of second elastic elements 14 which are grouped in pairs on both sides of at least one support zone 19, via which these second elastic elements 14 are attached to the first component 3.

When the oscillating mechanism 1 comprises at least one third component 6 which is connected to the anchorage 2 by at least one first elastic element 11, and to the first component 3 by at least one second elastic element 14, it advantageously comprises, at the level of the first component 3, second means for limiting the angular deflection 18 of the third component 6. And the anchorage 2 again forms other means for limiting the angular deflection of the third component 6 at the level of the lateral faces 6A, 6B.

Preferably, the range of inertia of the first component 3 relative to the axis D is greater than that of the second component 5 relative to the same axis.

In an advantageous, rigid embodiment, the first component 3 and the second component 5 are produced in the form of a lattice of thin blades or thin flexible blades.

In an advantageous, rigid embodiment, the third component 6 is produced in the form of a lattice of thin blades or thin flexible blades.

The first component 3 and the third component 6 can also be heavy, according to the level of inertia which is desired for these components.

In the preferred embodiment represented in the Figures, the elastic deformation of the components of the oscillating mechanism 1 is essentially planar, all the components being deformed elastically according to the same plane or according to planes which are parallel to each other. In the case of particular requirements associated with the kinematics, whilst preserving a substantially planar first component 3, it is possible, in an embodiment variant not illustrated by the Figures, to design the oscillating mechanism 1 so that the elastic deformation of some of its components comprises a component according to a normal to the plane P of the first component 3.

In a particular embodiment, in an embodiment variant not illustrated by the Figures, the elastic restoring means 10 are distributed over a plurality of parallel layers, and the elements which compose them are provided and joined to each other so as to allow an angular deflection of the first mobile component 3 with greater amplitude than that which is allowed by the deflections of the components, and by the support positions which they can represent one for the other. Any amplitude can thus be produced, in particular greater than one revolution of 360° of the first component 3.

For certain particular applications, the oscillating mechanism 1 comprises stopping means or at least one pawl in order to keep in position, at a distance from its position of equilibrium, all or part of the elements which make up the elastic restoring means 10, or also to keep in position, at a distance from its position of equilibrium, the first mobile component 3, or also to keep in position, at a distance from its position of equilibrium, the second mobile element 9.

The invention relates to the use of such an oscillating mechanism 1 for the production of a mobile element for transmitting energy 100 in order to decouple the inertia of one part of a train of wheels in a timepiece movement 1000 or a timepiece 10000.

The invention relates in particular to the application of such a mobile element for transmitting energy to a mechanism with constant force, where the mobile element for transmitting energy 100 forms an energy reservoir, termed "buffer", between the spring barrel and the escapement of a timepiece, thus allowing a constant moment to be transmitted to the escapement. The person skilled in the art will easily be able to use the mobile element according to the invention in order to integrate it in a device with constant force of the Jeanneret type, such as described in the document "Théorie générale de l'horlogerie, de Léopold Defossez, Chambre Suisse de l'Horlogerie, La Chaux-de-Fonds", (General theory of clock/watch making), volume II, page 129.

The invention also allows decoupling of the inertia of one part of a train of wheels: in the case of a tourbillon, for example, the inertia of the train of wheels to be set in motion with each impulse is large and impairs the efficiency of the escapement. A flexible wheel according to the invention, interposed between the elements with great inertia and the escapement, makes it possible for the escapement to be displaced rapidly before the great inertia is set in motion, indeed improving, in this way, the efficiency of the escapement. This application is particularly innovative and uses the compactness of the mobile element according to the invention advantageously.

If the invention is useful to store energy, before delivering it at the correct moment to a receiver mobile element, it is also entirely expedient for protecting a fragile element of a movement against impacts, or more generally, against high accelerations. In particular, its application for protecting a fragile escapement against impacts is efficacious. In fact, during stopping or during impacts on the hands, the moment transmitted into the train of wheels can be momentarily much greater than the moment of the spring barrel. If one typically has an escapement made of fragile material, such as silicon or another material obtained by MEMS technologies or obtained by a "LIGA" process or similar, possibly extremely skeletal in order to lighten it, there is a risk of breakage. Flexibility of a mobile element 100 according to the invention, judiciously placed in the train of wheels, makes it possible to absorb part of the energy of the impact. One finds similar protection to this offered by a wheel according to the patent OMEGA EP1870784, however with the difference that the invention makes it possible to use a rigid, non-deformable peripheral part, which is advantageous if it concerns a toothing, as can be seen in FIGS. 5 and 6.

The functions which are most advantageous to exploit are:

protection of a friction coupling during impacts or in normal operation;

for the same reasons as in the point above, a friction coupling might slide momentarily during an impact: external impact or stopping of the escapement. Flexibility in the train of wheels makes it possible to reduce the instantaneous moment peak transmitted through the coupling, for example in the case of a timer;

gearing without play: superposition of two faces, connected to each other by an angular restoring spring, in order to sandwich the teeth of a pinion.

The means which are used can consist of a face which is pivoted freely on the axis of the pinion, or a pinion pivoted on the axis of the face, with restoring spring (spiral spring or helical spring) between the pinion and the face.

It is possible to employ a plurality of types of flexible guides, guiding and flexibility are therefore combined:

flexible arms elastic system, termed butterfly, as can be seen in FIG. 5;

RCC pivot (remote centre compliance) with four necks, such as can be seen in FIG. 6.

In a preferred application, as can be seen in the Figures, and in particular FIGS. 5 to 9, the invention relates to a mobile element for transmitting energy 100 for a timepiece movement 1000, and this mobile element for transmitting energy 100 comprises such an oscillating mechanism 1 between at least one first emitter mobile element 2E of said movement 1000, on the one hand, and at least one second receiver mobile element 3R of the movement 100, on the other hand. The mobile element 1 comprises at least one degree of freedom by pivoting about the theoretical pivot axis D.

According to the invention, the first elastic restoring means 300 and the second elastic restoring means 500 together form elastic restoring means 10 which produce a direct or indirect elastic connection between a first axial part 200 and a second peripheral part 600. The first axial part 200 is situated in the vicinity of the pivot axis D and cooperates with the first emitter mobile element 2E or respectively the second receiver mobile element 3R, and the second peripheral part 600 is at a radial spacing from the pivot axis D and cooperates with the second receiver mobile element 3R or respectively the first emitter mobile element 2E. These elastic restoring means 10 are designed, as the case may be, to absorb, to store or to set free the energy during an angular deflection, by pivoting about a secondary axis D1 which is parallel to or coincides with the pivot axis D, between the first axial part 200 and the second peripheral part 600. For preference, the first axial part 200 and the second peripheral part 600 are coaxial in the free state, and the elastic restoring means 10 are also designed to keep the first axial part 200 and the second peripheral part 600 coaxial during deformation of the elastic restoring means 10.

According to a feature of the invention, the second peripheral part 600 is rigid and non-deformable.

According to a feature of the invention, the elastic connection produced by the elastic restoring means 10 is substantially planar in a plane perpendicular to the theoretical pivot axis D.

According to a feature of the invention, the angular deflection by pivoting of the second peripheral part 600 is of several degrees or several tens of degrees.

According to a feature of the invention, the elastic restoring means 10 comprise at least one arm 70 which extends between said first axial part 200 and said second peripheral part 600, and this arm 70 comprises at least one elastic part.

According to a feature of the invention, the arm 70 is elastic.

According to a feature of the invention, the elastic restoring means 10 comprise at least one arm 70 comprising at least one rigid part 120 which extends between the first axial part 200 and the second peripheral part 600, to which it is connected respectively by at least one first elastic blade 80 and by at least one second elastic blade 90.

According to a feature of the invention, the elastic restoring means 10 comprise a plurality of such arms 70 which are situated in planes which are parallel to or coincide with each other and are all perpendicular to the theoretical pivot axis D.

According to a feature of the invention, the elastic restoring means 10 comprise at least one arm 70 comprising a plurality of rigid parts 120 which extend between the first axial part 200 and the second peripheral part 600, to which they are connected respectively by at least one first elastic blade 80A of a first of the rigid parts 120A and by at least one second elastic blade 90B of a second said rigid part 120B, these rigid parts 120 being connected to each other exclusively by an elastic part 130.

According to a feature of the invention, this elastic part 130 comprises at least one elastic blade 140.

According to a feature of the invention, as can be seen in FIG. 5, the mobile element for transmitting energy 100 assumes a configuration of the butterfly type comprising at least one arm 70 comprising at least one rigid part 120 which extends between said first axial part 200 and said second peripheral part 600, to which it is connected respectively by at least one first elastic blade 80 and by at least one second elastic blade 90, the rigid part 120 forming an intermediate mass which is substantially mobile by pivoting about the theoretical pivot axis D.

According to a feature of the invention, as can be seen in FIG. 6, the mobile element for transmitting energy 100 assumes a configuration of the RCC pivot type with four necks, comprising two arms 70 which are non-aligned, each comprising at least one rigid part 120 which extends between the first axial part 200 and the second peripheral part 600, to which it is connected respectively by at least one first elastic blade 80 and by at least one second elastic blade 90.

According to a feature of the invention, the two arms 70 form between them an angle which is substantially centred on the theoretical pivot axis D and close to 90°.

According to a feature of the invention, the elastic restoring means 10 have an angular deflection which is limited to a pivot movement of the first part 200 relative to the second part 600, determined by the means for limiting the angular deflection.

According to a feature of the invention, the elastic restoring means 10 have a rigidity which is very much less than that of the first part 200 and of the second part 600, in a ratio less than 0.30 relative to the lowest of the rigidities of the first part 200 or of the second part 600.

According to a feature of the invention, the elastic restoring means 10 are formed by blades which are substantially radial relative to the theoretical pivot axis D.

In a variant of the invention, not represented in the Figures, at least one of the elastic restoring means is produced in the form of a spiral spring. In a particular embodiment, the oscillating mechanism 1 is a monobloc spiral balance wheel made of silicon or similar.

According to a feature of the invention, the mobile element for transmitting energy 100 is produced in a micromachinable material, or silicon, or quartz or one of their compounds, or an alloy originating from MEMS technology, or an alloy such as obtained by the "LIGA" process, or a material which is at least partially amorphous. In a particular embodiment, it is produced in a combination of some of these materials, the material being a rigid material with a Young's modulus greater than 80,000 MPa.

The invention also relates to a timepiece movement 1000 comprising at least one such mobile element for transmitting energy 100.

The invention also relates to a timepiece 10000 comprising at least one such movement, or/and at least one such mobile element for transmitting energy 100, or/and at least one such oscillating mechanism 1.

It is understood that the application field of the invention is extremely wide.

The invention makes is possible to obviate the difficulties of manufacture and adjustment, or even of assembly and connection which are linked to certain components such as the spiral springs. It provides a very compact solution to the problem of producing mechanical oscillators of the mass-spring type. The invention makes it possible to produce a mechanism of very low thickness and permits new possibilities for equipment in timepieces, in particular with the always consumer-linked complications of volume. The possibility of doing without pivots represents great technological progress in clock/watch making.

The manufacturing precision is very high thanks to the use of micromachinable materials, in particular silicon or silicon oxide or similar. Controlling the masses, and especially the inertias, is complete. This signifies that a direct consequence of using the invention is very great simplification in adjustments on a timepiece, i.e. reduction in adjustments.

Of course, this technology can be directly used in the field of nanotechnologies, for the production of rotary actuators, oscillators or others.

The invention also relates to the use of such a mobile element for transmitting energy 100 for decoupling the inertia of one part of a train of wheels in a timepiece movement comprising, on the one hand, an escapement and, on the other hand, a second mobile element of inertia which is greater than that of said escapement, by interposition of said mobile element for transmitting energy 100 either directly or in a train of wheels, between said escapement and said second mobile element in order to allow rapid pivoting of said escapement before said second mobile element is set in motion with each impulse.

The invention also relates to the use of a mobile element for transmitting energy 100 where said second mobile element is a tourbillon or a carousel.

The invention also relates to the use of a mobile element for transmitting energy 100 where said escapement comprises an escapement wheel formed by such a mobile element for transmitting energy 100.

The invention also relates to the use of such a mobile element for transmitting energy 100 in order to absorb excess energy in a train of wheels of a timepiece movement when a moment transmitted to said train of wheels by an impact or high acceleration or during stopping of the escapement is momentarily very much higher than the moment of a spring barrel feeding said movement with energy, by producing at least one of the elements of said train of wheels in the form of said mobile element for transmitting energy 100.

The invention also relates to the use of such a mobile element for transmitting energy 100 for a said timepiece movement comprising an escapement, characterised in that said escapement comprises an escapement wheel formed by a said mobile element for transmitting energy 100.

The invention also relates to the use of such a mobile element for transmitting energy 100 in order to absorb excess energy in a timepiece movement comprising a train of wheels and at least one friction coupling, when a moment transmitted to said train of wheels by an impact or high acceleration or during stopping of the escapement is momentarily very much higher than the moment of a spring barrel feeding said movement with energy, by producing at least one of the said elements of said train of wheels in the form of a said mobile element for transmitting energy 100, in order to reduce the instantaneous moment peak transmitted through said friction coupling.

The invention also relates to the use of such a mobile element for transmitting energy 100 for a said timepiece movement of a timer comprising at least one friction coupling.

The invention also relates to the use of such a mobile element for transmitting energy 100 for a timepiece movement comprising, between a spring barrel for storing energy and an escapement, a train of wheels comprising at least one said mobile element for transmitting energy 100 in order to form an energy reservoir buffer between said spring barrel and said escapement in order to transmit a constant moment to said escapement.

The invention also relates to the use of such a mobile element for transmitting energy 100 for a timepiece movement comprising two faces connected to each other by an angular restoring spring formed by a said mobile element for transmitting energy 100, in order to sandwich the teeth of a pinion and to form a meshing mechanism without play.

The invention also relates to the use of such a mobile element for transmitting energy 100 in a timepiece movement in which said first emitter mobile element 2E or else said second receiver mobile element 3R of said movement 1000 is kept fixed in anchorage relative to a bottom plate or to a bridge which said timepiece movement comprises.

Of course the present invention is not limited to the illustrated example but is able to have various variants and modifications which will be evident to the person skilled in the art.

The invention claimed is:

1. An oscillating mechanism for a timepiece movement, comprising:

a first rigid element and a second rigid element, each one configured to be fixed on a different element of said movement and at least one of which is mobile relative to the other and pivots about a theoretical pivot axis;

said oscillating mechanism being flexible with a variable geometry whilst being produced in a monobloc manner;

a first elastic restoring means which produces a direct or indirect elastic connection between said first rigid element and an intermediate rigid element;

at least a second elastic restoring means which produces a direct or indirect elastic connection between said intermediate rigid element and said second rigid element, wherein said first rigid element, said first elastic restoring means, said intermediate rigid element, said second elastic restoring means, and said second rigid element are coplanar according to one plane and are configured to be deformed according to said plane, wherein the oscillating mechanism assumes a configuration of butterfly type, comprising said intermediate rigid element, formed by at least one rigid arm which extends between said first rigid element disposed in a vicinity of said pivot axis and said second rigid element forming a peripheral part, to which said first rigid element is connected respectively by said first elastic restoring means formed by at least one first elastic blade, and by said second elastic restoring means formed by at least one second elastic blade, said at least one rigid arm forming an intermediate mass which is mobile by pivoting about said pivot axis, said first elastic restoring means comprises a plurality of first elastic blades which respectively form dihedrons with a V extending radially relative to said pivot axis, the point of said V being directed towards said pivot axis, and said second elastic restoring means comprises a plurality of second elastic blades which respectively form dihedrons with a V extending radially relative to said pivot axis, the point of said V being directed towards said pivot axis.

2. The oscillating mechanism according to claim 1, wherein both said first elastic restoring means and said second elastic restoring means have an angular deflection limited by means for limiting angular deflection.

3. The oscillating mechanism according to claim 1, wherein said second rigid element forms an anchorage immobile relative to a bottom plate or to a bridge which comprises said movement, and wherein said first rigid element or said second rigid element comprises means for receiving an impulse exerted counter to said first elastic restoring means and said second elastic restoring means, which together form combined elastic restoring means which are configured to make said first rigid element oscillate about said pivot axis, said combined elastic restoring means forming a virtual elastic pivot which releases said oscillating mechanism from any fixing on an arbor or pivot, and also wherein said combined elastic restoring means are symmetric in relation to said pivot axis and comprise means for balancing forces exerted on said first rigid element to keep its instantaneous pivot axis as close as possible to said pivot axis.

4. The oscillating mechanism according to claim 1, produced in a micromachinable material, or silicon, or silicon oxide, or quartz, or one of their compounds, said material being a rigid material with a Young's modulus greater than 80,000 MPa.

5. The oscillating mechanism according to claim 1, wherein said first rigid element further includes an impulse pin to cooperate with a set of pallets.

6. The oscillating mechanism according to claim 1, wherein said second rigid element is integral with a pallet staff of a set of pallets, or of Swiss pallets, or of detent pallets, with an elastic pivot, of an escapement mechanism of the timepiece.

7. A timepiece movement comprising:

at least one mobile element for transmitting energy which comprises an oscillating mechanism according to claim 1, between at least one first emitter mobile element of said movement and at least one second receiver mobile element of said movement, said first emitter mobile element and said second receiver mobile element being mobile relative one to the other, said oscillating mechanism allowing at least one degree of freedom by pivoting about said theoretical pivot axis, wherein said first elastic restoring means and said second elastic restoring means together form combined elastic restoring means which produce a direct or indirect elastic connection between a first axial part and a second peripheral part, said first axial part being situated in a vicinity of said pivot axis and cooperating with said first emitter mobile element or respectively the second receiver mobile element, and said second peripheral part being at a radial spacing from said pivot axis and cooperating with said second receiver mobile element or respectively the first emitter mobile element, and said combined elastic restoring means being configured to absorb, to store, or to set free the energy during an angular deflection by pivoting about a secondary axis which is parallel to or coincides with said pivot axis, between said first axial part and said second peripheral part.

8. The timepiece movement according to claim 7, wherein said first axial part and said second peripheral part are coaxial in a free state, and wherein said combined elastic restoring means are also configured to keep said first axial part and said second peripheral part coaxial during deformation of said combined elastic restoring means.

9. The timepiece movement according to claim 7, wherein either said first emitter mobile element or said second receiver mobile element of said movement or said second rigid element is kept fixed by anchoring relative to a bottom plate or to a bridge which said timepiece movement comprises.

10. The timepiece movement according to claim 7, further comprising:

a train of wheels;

an escapement; and a second mobile element, or a tourbillon, or a carousel, of inertia which is greater than that of said escapement, and wherein said mobile element for transmitting energy is interposed between said escapement and said second mobile element, either directly or in a train of wheels to decouple inertia of one part of said train of wheels to allow rapid pivoting of said escapement before said second mobile element is set in motion with each impulse.

11. The timepiece movement according to claim 10, wherein said escapement comprises an escapement wheel formed by said oscillating mechanism.

12. The timepiece movement according to claim 7, further comprising:

an escapement mechanism; and a train of wheels, of which at least one of the elements is formed by said oscillating mechanism to absorb excess energy in said train of wheels, when a moment transmitted to said train of wheels by an impact or high acceleration or during stopping of the escapement is momentarily very much higher than the moment of a spring barrel feeding said movement with energy.

13. The timepiece movement according to claim 12, wherein said escapement comprises an escapement wheel formed by said oscillating mechanism.

14. The timepiece movement according to claim 7, further comprising;

a train of wheels;

an escapement mechanism; and at least one friction coupling, of which at least one of the elements of said train of wheels is formed by said oscillating mechanism, to absorb excess energy in said movement, to reduce an instantaneous moment peak which is transmitted through said friction coupling, when a moment transmitted to said train of wheels by an impact or high acceleration or during stopping of the escapement is momentarily very much higher than a moment of a spring barrel feeding said movement with energy.

15. The timepiece movement according to claim 14, including a timer mechanism comprising said friction coupling.

16. The timepiece movement according to claim 7, further comprising:

between a spring barrel for storing energy and an escapement, a train of wheels comprising at least one said oscillating mechanism to form an energy reservoir buffer between said spring barrel and said escapement, to transmit a constant moment to said escapement.

17. A timepiece comprising a movement according to claim 7.

18. A timepiece comprising at least one oscillating mechanism according to claim 1.

19. An escapement-oscillator block configured to regulate the timekeeping of a timepiece, the escapement-oscillator block comprising:

an escapement mechanism; and a mechanical rotary oscillator, said escapement mechanism including a set of pallets, or of Swiss pallets, or of detent pallets, and an elastic pivot, said elastic pivot including a first rigid element and a second rigid element, the second rigid element being integral with a pallet staff of the set of pallets, or of Swiss pallets, or of detent pallets, the second rigid element being mobile relative to the first rigid element;

a first elastic restoring means which produces a direct or indirect elastic connection between said first rigid element and an intermediate rigid element;

at least a second elastic restoring means which produces a direct or indirect elastic connection between said intermediate rigid element and said second rigid element, wherein said first rigid element, said first elastic restoring means, said intermediate rigid element, said second elastic restoring means, and said second rigid element are coplanar according to one plane and are configured to be deformed according to said plane, wherein said elastic pivot assumes a configuration of butterfly type, comprising said intermediate rigid element, formed by at least one rigid arm which extends between said first rigid element disposed in a vicinity of said pivot axis and said second rigid element forming a peripheral part, to which said first rigid element is connected respectively by said first elastic restoring means formed by at least one first elastic blade, and by said second elastic restoring means formed by at least one second elastic blade, said at least one rigid arm forming an intermediate mass which is mobile by pivoting about said pivot axis, said first elastic restoring means comprises a plurality of first elastic blades which extend radially relative to said pivot axis or respectively form dihedrons with a V extending radially relative to said pivot axis, the point of said V being directed towards said pivot axis, and said second elastic restoring means comprises a plurality of second elastic blades which extend radially relative to said pivot axis or respectively form dihedrons with a V extending radially relative to said pivot axis, the point of said V being directed towards said pivot axis, and said mechanical rotary oscillator including a balance plate having an impulse pin to cooperate with the set of pallets of the escapement mechanism, at least one anchorage configured to be fixed on an element of a timepiece movement such that the balance plate is mobile relative to the anchorage and pivots about a theoretical pivot axis, the mechanical rotary oscillator being flexible with a variable geometry whilst being produced in a monobloc manner, a first elastic restoring means which produces a direct or indirect elastic connection between said first rigid element and a balance rim, at least a second elastic restoring means which produces a direct or indirect elastic connection between said balance rim and said anchorage, wherein said balance plate, said first elastic restoring means, said balance rim, said second elastic restoring means, and said anchorage are coplanar according to one plane and are configured to be deformed according to said plane, wherein the mechanical rotary oscillator assumes a configuration of butterfly type, comprising said balance rim, formed by at least one rigid arm which extends between said balance plate disposed in a vicinity of said pivot axis and said balance rim forming a peripheral part, to which said balance plate is connected respectively by said first elastic restoring means formed by at least one first elastic blade, and by said second elastic restoring means formed by at least one second elastic blade, said at least one rigid arm forming an intermediate mass which is mobile by pivoting about said pivot axis, said first elastic restoring means comprises a plurality of first elastic blades which extend radially relative to said pivot axis or respectively form dihedrons with a V extending radially relative to said pivot axis, the point of said V being directed towards said pivot axis, and said second elastic restoring means comprises a plurality of second elastic blades which extend radially relative to said pivot axis or respectively form dihedrons with a V extending radially relative to said pivot axis, the point of said V being directed towards said pivot axis.

20. An assembly comprising:

an escapement-oscillator block; and a boring for centering an escapement wheel configured to provide energy necessary for maintaining the oscillation;

said escapement-oscillator block including an escapement mechanism, and a mechanical rotary oscillator, said escapement mechanism including a set of pallets, or of Swiss pallets, or of detent pallets, and an elastic pivot, said elastic pivot including a first rigid element and a second rigid element, the second rigid element being integral with a pallet staff of the set of pallets, or of Swiss pallets, or of detent pallets, the second rigid element being mobile relative to the first rigid element;

a first elastic restoring means which produces a direct or indirect elastic connection between said first rigid element and an intermediate rigid element;

at least a second elastic restoring means which produces a direct or indirect elastic connection between said intermediate rigid element and said second rigid element, wherein said first rigid element, said first elastic restoring means, said intermediate rigid element, said second elastic restoring means, and said second rigid element are coplanar according to one plane and are configured to be deformed according to said plane, wherein said elastic pivot assumes a configuration of butterfly type, comprising said intermediate rigid element, formed by at least one rigid arm which extends between said first rigid element disposed in a vicinity of said pivot axis and said second rigid element forming a peripheral part, to which said first rigid element is connected respectively by said first elastic restoring means formed by at least one first elastic blade, and by said second elastic restoring means formed by at least one second elastic blade, said at least one rigid arm forming an intermediate mass which is mobile by pivoting about said pivot axis, said first elastic restoring means comprises a plurality of first elastic blades which respectively form dihedrons with a V extending radially relative to said pivot axis, the point of said V being directed towards said pivot axis, and said second elastic restoring means comprises a plurality of second elastic blades which respectively form dihedrons with a V extending radially relative to said pivot axis, the point of said V being directed towards said pivot axis, and said mechanical rotary oscillator including a balance plate having an impulse pin to cooperate with the set of pallets of the escapement mechanism, at least one anchorage configured to be fixed on an element of a timepiece movement such that the balance plate is mobile relative to the anchorage and pivots about a theoretical pivot axis, the mechanical rotary oscillator being flexible with a variable geometry whilst being produced in a monobloc manner, a first elastic restoring means which produces a direct or indirect elastic connection between said first rigid element and a balance rim, at least a second elastic restoring means which produces a direct or indirect elastic connection between said balance rim and said anchorage, wherein said balance plate, said first elastic restoring means, said balance rim, said second elastic restoring means, and said anchorage are coplanar according to one plane and are configured to be deformed according to said plane, wherein the mechanical rotary oscillator assumes a configuration of butterfly type, comprising said balance rim, formed by at least one rigid arm which extends between said balance plate disposed in a vicinity of said pivot axis and said balance rim forming a peripheral part, to which said balance plate is connected respectively by said first elastic restoring means formed by at least one first elastic blade, and by said second elastic restoring means formed by at least one second elastic blade, said at least one rigid arm forming an intermediate mass which is mobile by pivoting about said pivot axis, said first elastic restoring means comprises a plurality of first elastic blades which extend radially relative to said pivot axis or respectively form dihedrons with a V extending radially relative to said pivot axis, the point of said V being directed towards said pivot axis, and said second elastic restoring means comprises a plurality of second elastic blades which extend radially relative to said pivot axis or respectively form dihedrons with a V extending radially relative to said pivot axis, the point of said V being directed towards said pivot axis, wherein the assembly is produced in two parts of an SOI wafer, in a device layer of the SOI wafer for said escapement-oscillator block including said set of pallets and elastic pivot and said mechanical rotary oscillator, and in a handle layer of the SOI wafer for anchoring said set of pallets and said mechanical rotary oscillator and for said centering boring of an escapement wheel.

21. An oscillating mechanism for a timepiece movement, comprising:

a first rigid element to be fixed on a first timepiece movement element;

a second rigid element to be fixed on a second timepiece movement element different from the first timepiece movement element, at least one of the first and second rigid elements being mobile relative to the other and pivoting about a theoretical pivot axis, the first rigid element being disposed in a vicinity of the theoretical pivot axis and the second rigid element being disposed in a periphery of the oscillating mechanism, away from the theoretical pivot axis;

an intermediate rigid element disposed between the first rigid element and the second rigid element;

a first elastic restoring means that connects the first rigid element to the intermediate rigid element, the first elastic restoring means including a plurality of first elastic blades which respectively form dihedrons with a V extending radially relative to said pivot axis, the point of said V being directed towards said pivot axis; and a second elastic restoring means that connects the second rigid element to the intermediate rigid element, the second elastic restoring means including a plurality of second elastic blades which respectively form dihedrons with a V extending radially relative to said pivot axis, the point of said V being directed towards said pivot axis, wherein the first rigid element, the first elastic restoring means, the intermediate rigid element, the second elastic restoring means, and the second rigid element are formed as a monobloc to be coplanar such that the first elastic restoring means and the second elastic restoring means are elastically deformable in a single plane and the intermediate rigid element and the second rigid element are pivotable in the plane about the theoretical pivot axis by elastic deformations of the first and second elastic restoring means.

* * * * *